United States Patent [19]

Ohno

[11] Patent Number: 4,888,621

[45] Date of Patent: Dec. 19, 1989

[54] MULTIPLE IMAGE FORMING APPARATUS WITH CHARGER TO PREVENT DISTURBANCE OF ALREADY-TRANSFERRED IMAGES

[75] Inventor: Akio Ohno, Tokyo, Japan

[73] Assignee: Canon Kabushiki Kaisha, Tokyo, Japan

[21] Appl. No.: 171,220

[22] Filed: Mar. 22, 1988

Related U.S. Application Data

[63] Continuation of Ser. No. 82,580, Aug. 7, 1987, abandoned.

[30] Foreign Application Priority Data

Aug. 11, 1986 [JP] Japan ..... 61-189140

[51] Int. Cl.[4] ..... G03G 15/01; G03G 15/00

[52] U.S. Cl. ..... 355/326; 355/219; 355/271

[58] Field of Search ..... 355/4, 3 TR, 3 CH, 14 TR, 355/14 CH, 3 DD, 14 D, 326, 327, 210, 219, 268, 271, 274, 276

[56] References Cited

U.S. PATENT DOCUMENTS

| | | | |
|---|---|---|---|
| 4,200,387 | 4/1980 | Masumura | 355/15 |
| 4,515,460 | 5/1985 | Knechtel | 355/4 X |
| 4,540,275 | 9/1985 | Iwahashi | 355/3 CH X |

FOREIGN PATENT DOCUMENTS

| | | | |
|---|---|---|---|
| 55-38526 | 3/1980 | Japan | 355/4 |
| 61-67872 | 4/1986 | Japan | 355/4 |
| 61-83557 | 4/1986 | Japan | 355/4 |
| 61-138265 | 6/1986 | Japan | 355/14 TR |

*Primary Examiner*—Arthur T. Grimley
*Assistant Examiner*—J. Pendegrass
*Attorney, Agent, or Firm*—Fitzpatrick, Cella, Harper, Scinto

[57] ABSTRACT

In an image formation apparatus for sequentially forming toner images on an image carrier and transferring the toner images onto a transfer material on a transfer material support member which is moved in an endless manner, when the transfer material is brought into contact with the image carrier other than in a transfer process, the surface of the image carrier is maintained at the same polarity as that of toner transferred to the transfer material. Thus, toner image transferred to the transfer material can be prevented from being offset onto the image carrier.

20 Claims, 6 Drawing Sheets

MULTIPLE IMAGE FORMING APPARATUS WITH CHARGER TO PREVENT DISTURBANCE OF ALREADY-TRANSFERRED IMAGES

This application is a continuation of application Ser. No. 082,580, filed Aug. 7, 1987, now abandoned.

BACKGROUND OF THE INVENTION

1. Field of the Invention

The present invention relates to an image formation apparatus which has a plurality of developing units, and develops a latent image formed on an image carrier to obtain a toner image and sequentially transfers and overlaps toner images on a transfer material to obtain a desired image.

2. Related Background Art

In a conventional image formation apparatus, a transfer material is supported on a drum-like transfer material supporting member, and toner images formed on an image carrier can be multiple-transferred a plurality of times to a single transfer material.

For example, in a color image formation apparatus, yellow(Y), magenta(M), cyan(C), and black(BK) developing units are arranged, and the transfer material support member is rotated four times so as to transfer toner images of four colors, e.g., yellow, magenta, cyan, and black images since a toner image of one color on an image carrier is transferred per rotation of the transfer material support member.

However, after an image of one color is transferred per rotation of the support member, an image formation process for the next color is not yet completed upon the next rotation depending on the size of the transfer material. Therefore, the support member is rotated once more, and a transfer operation for the next color is performed upon the second next rotation. More specifically, the transfer drum is subjected to a rotation for the transfer process and an extra rotation. Therefore, in order to complete the transfer processes for the four colors, at least three extra rotations are necessary.

During the extra rotation without the transfer process, since the toner image which has been already transferred onto the transfer material is again in contact with the surface of the image carrier, toner is offset from the toner image on the transfer material onto the surface of the image carrier due to this contact, thus blurring the transferred image.

SUMMARY OF THE INVENTION

It is an object of the present invention to solve the above problem.

It is another object of the present invention to prevent offset of toner on a transfer material to an image carrier during a non-transfer operation between transfer operations.

According to the present invention, when the transfer material is brought into contact with an image carrier in a state other than the transfer process, the surface of the image carrier is kept at a current of the same polarity as that of the toner transferred to the transfer material.

DETAILED DESCRIPTION OF THE PREFERRED EMBODIMENT

Figure 3:
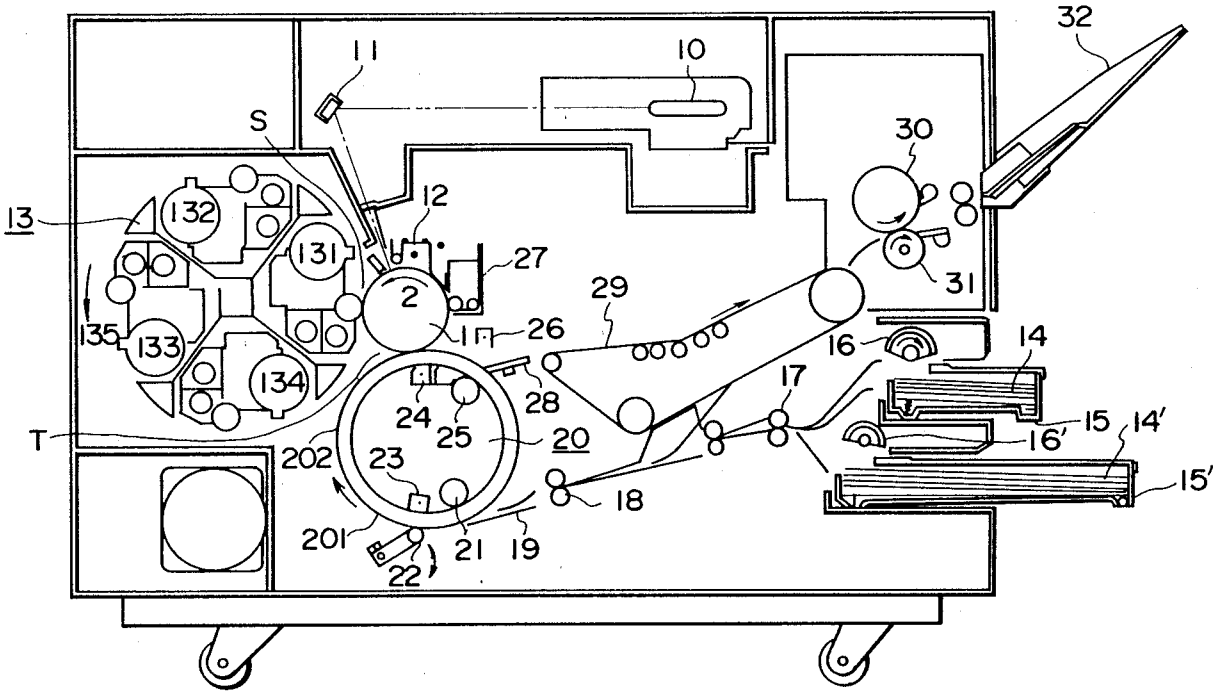
FIG. 3 is a sectional view of a color multiple recording apparatus to which the present invention is applied.

The present invention will now be described in detail with reference to the accompanying drawings. FIG. 3 shows a multi-color image formation apparatus (to be referred to as a printer hereinafter) to which the present invention is applied, and employs an electrophotography method.

In FIG. 3, a photosensitive drum 1 constituting an image carrier is rotated in a direction indicated by arrow 2. A charger 12, a developing unit group 13, a transfer drum 20, a cleaning device 27, and the like are arranged around the photosensitive drum 1. Laser optical systems 10 and 11 form an image on the drum 1 in accordance with color-separated image information signals. In addition, a polygonal mirror 10 and a laser reflection mirror 11 are arranged. The developing unit group 13 consists of rotary developing units 131, 132, 133 and 134 respectively using Y, M, C, and BK developing agents.

When an image of a specific color is formed on the drum 1, the developing unit 131, 132, 133, or 134 of the corresponding color approaches the drum 1 to form an image. When an image of a different color is formed, the developing unit group 13 is rotated in the direction indicated by arrow 135, so that the developing unit of the desired color comes closer to the drum 1.

A cassette 15 stores transfer materials 14 (normally, paper sheets are used). A transfer material 14 (to be referred to as a transfer sheet 14 hereinafter) in the cassette 15 is fed from the cassette 15 by a paper feed roller 16, passes by a pair of first register rollers 17 and a pair of second register rollers 18, and is conveyed to a paper guide 19. The transfer sheet is synchronized by the first and second register rollers 17 and 18 upon passage, and its leading end is then gripped by a gripper 201 on the transfer drum 20. The gripped transfer sheet passes between an attraction charger 23 and a press roller 22, and is attracted on the entire surface of an attraction sheet 202 on the transfer drum 20. An image on the drum 1 is transferred to the attracted transfer sheet by a transfer charger 24. The transfer process is repeated a plurality of times corresponding to the number of colors. After the transfer process is completed, the gripper is opened, and the transfer sheet is then guided toward a convey section 29 by a separation pawl 28. The transfer sheet guided to the convey section 29 passes between a pair of fixing rollers 30 and 31 to fix the transferred image, and is discharged onto a tray 32. After the transfer process, a residual image on the drum 1 is cleaned by the cleaning device 27, so as to prepare for the next image formation. The gripper on the transfer drum is opened/closed by cams 25 and 21.

Figure 4:
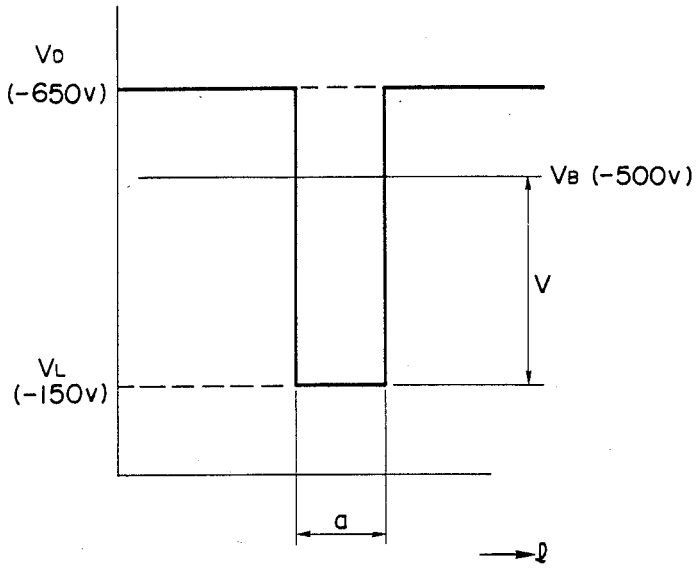
FIG. 4 is a graph showing a surface potential of a photosensitive drum of the present invention.

FIG. 4 is provided for explaining a surface potential on the drum in this embodiment.

Figure 2:
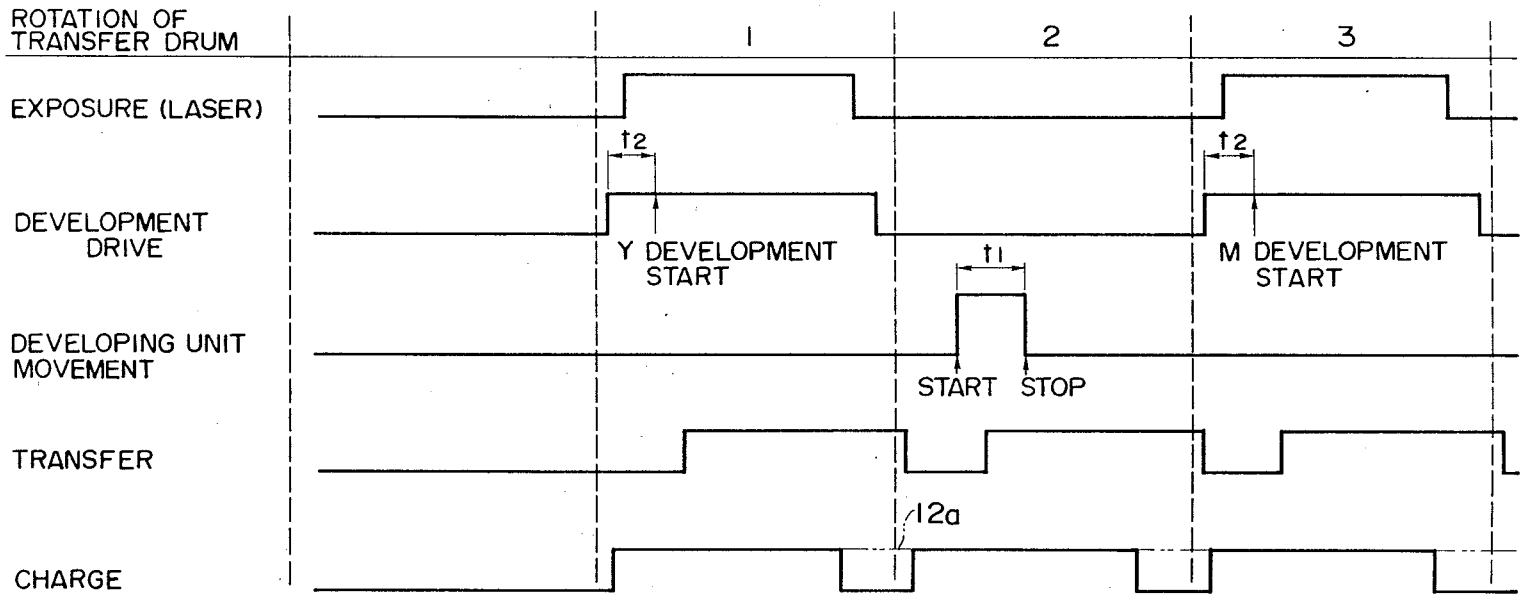
FIG. 2 is a timing chart when an extra rotation is necessary.

The drum surface is uniformly changed to VD (−650 V) by the charger 12 shown in FIG. 2, and the surface potential of a portion a irradiated with a laser beam is decreased to VL (−150 V). Upon development, toner which is charged to a negative (−) potential is applied to the portion a on the drum surface while applying a developing bias VB (−500 V). A halftone portion in which toner is electrostatically attached to the drum is reproduced by controlling the contrast potential $VC=VL-VB(300\ V)$ by laser beam modulation so as to control the amount of attracted toner.

Since a portion on which no laser beam is radiated maintains the drum surface potential VD, no toner is attached and is left white.

Figure 1:
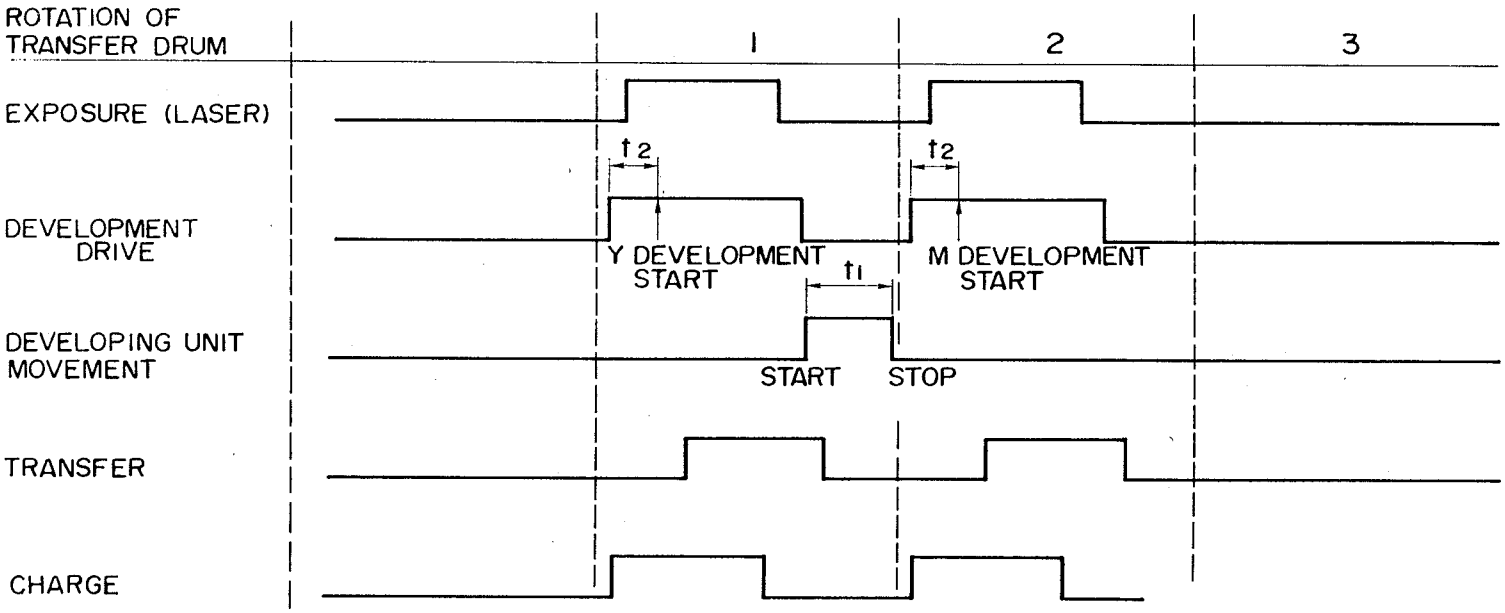
FIG. 1 is a timing chart when no extra rotation is necessary.

FIGS. 1 and 2 show timing charts when the present invention is applied to the printer having the above arrangement and processes.

FIG. 1 shows a case wherein no extra rotation is necessary, i.e., wherein the transfer material is short in a transfer rotational direction. A description will be made under the assumption that the transfer sheet in this case is an A4-sized sheet. FIG. 2 shows a case wherein an extra rotation is necessary, i.e., wherein the transfer sheet is long. A description will be made under the assumption that the transfer sheet in this case is an A3-sized sheet.

First, the case of FIG. 1 will be described. In order to form a Y image of the first color, the charger 12 is energized for a period corresponding to the sheet size to uniformly charge the drum surface. The laser beam is radiated in accordance with image information, and a latent image of the Y (yellow) image is formed on the photosensitive drum 2. The Y developing unit is moved in advance to the developing position, and starts a developing operation to visualize the Y image. The developing operation is started earlier than the leading end of the image at the developing position S by a time t2 in consideration of the time t2 until a developing sleeve reaches a predetermined rotating speed. At a transfer position T, the transfer charger 24 is energized in synchronism with the moving timing of the transfer sheet held on the transfer drum, and the Y image can be transferred by the single rotation of the transfer drum.

After the Y image is developed, the rotary developing unit group is rotated to prepare for next development of an M (magenta) image, so that the M developing unit is moved to the developing position S. Upon the second rotation of the transfer drum, the M image is formed on the photosensitive drum and is transferred in the same manner as described above.

In this manner, when the transfer sheet is an A4-sized sheet (JIS standard: 210 mm×297 mm), since a latent image developing/transfer process can be completed during a single rotation of the transfer drum, transfer images of four colors ca be obtained by four rotations of the transfer drum.

When the transfer sheet is an A3-sized sheet (having an area twice that of the A4-sized sheet JIS standard: 297 mm=420 mm), since the transfer size is prolonged as shown in FIG. 2, output times of the charger and the laser beam for forming a latent image, a developing time, and a transfer time are respectively prolonged accordingly. For this reason, the time required for moving the next developing unit to the image transfer position and the developing time cannot fall within a time required for a single rotation of the transfer drum. Therefore, the extra rotation of the transfer drum is performed (the second rotation of the transfer drum in FIG. 2), and the movement of the developing unit is performed during the extra rotation.

Therefore, the latent image forming developing/-transfer process is performed during the first rotation of the transfer drum for the Y image, during the third rotation for the M image, during the fifth rotation for the C (cyan) image, and during the seventh rotation for the BK (black) image in the timing chart shown in FIG. 2. During the second, fourth, and sixth rotations of the transfer drum, the M, C, and BK developing units are respectively moved to the developing position.

During the even-numbered rotation of the transfer drum, the potential of the drum surface is controlled by the primary charger so that the toner image which has already been transferred onto the transfer sheet is not offset onto the surface of the photosensitive drum. In this embodiment, as shown in FIG. 4, since negative polarity (−) toner is used, the drum surface is charged to a negative potential, i.e., −650 V. During the extra rotation, in order to increase an attraction force or bias between the transfer sheet and the toner on the transfer sheet, the transfer charger is energized.

In this embodiment, the extra rotation is performed during the time required for exchanging the rotary developing units in the case of an A3-sized sheet. In a copying machine, this also applies to the case wherein an image scan optical system is returned to the home position.

According to the present invention as described above, the surface potential of the photosensitive drum is controlled and the transfer charger is energized during the extra rotation of the transfer drum, so as to prevent the toner transferred on the transfer sheet from being offset onto the photosensitive drum.

In the above embodiment, the charger 12 is operated as shown in FIG. 2. In this case, as indicated by an alternate long and two short dashed line in FIG. 2, after the charger 12 is started, it can be kept ON without being turned off. Another charging means may be arranged in addition to the charger 12.

Figure 5:
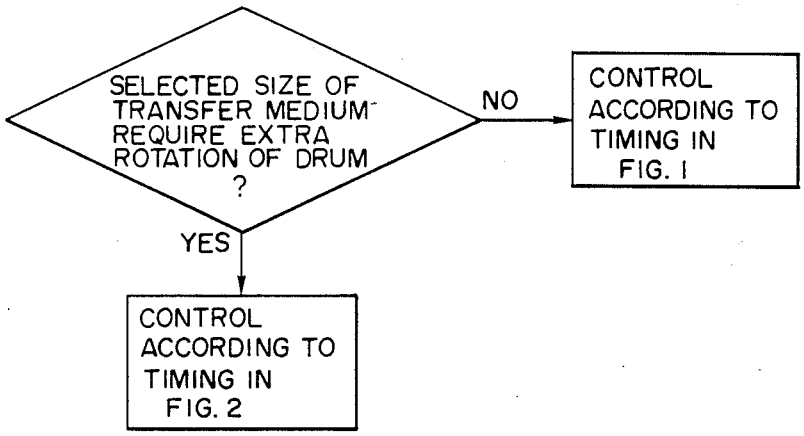
FIGS. 5 to 7 are flow charts for explaining the operation of the apparatus according to an embodiment of the present invention.
Figure 6:
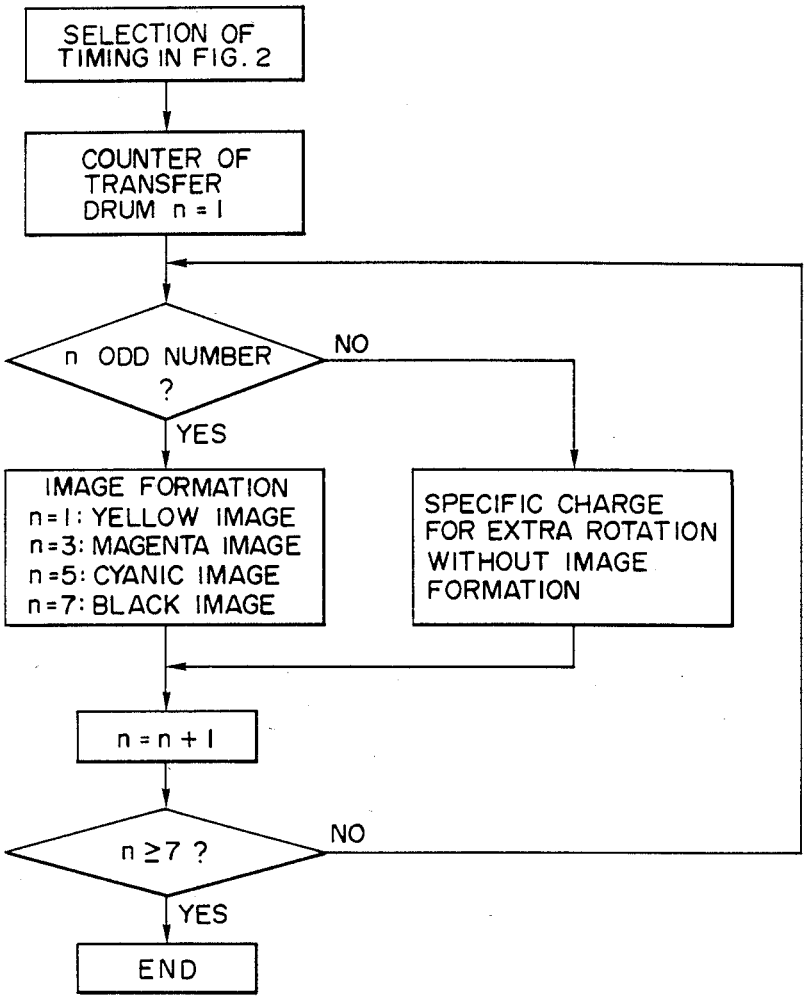
Figure 7:
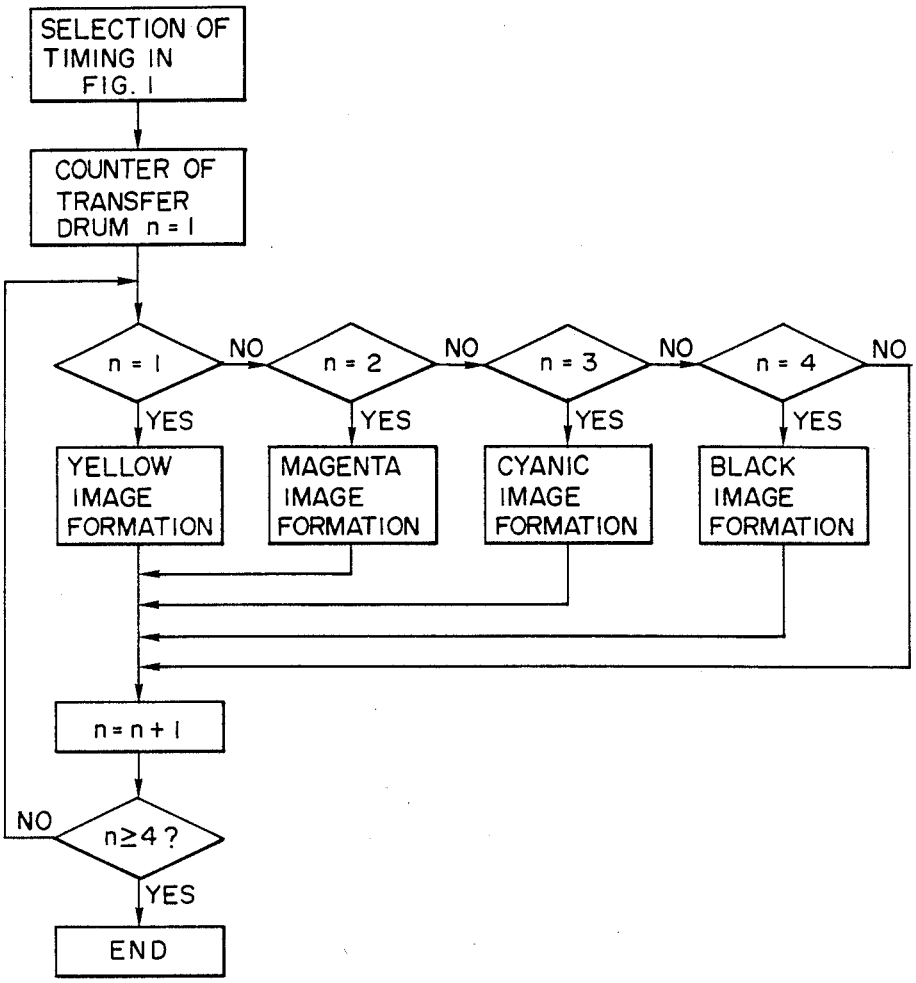

FIGS. 5 to 7 are flow charts for realizing the operation shown in FIGS. 1 and 2. FIG. 5 shows steps for determining whether or not the size of the selected transfer sheet requires an extra rotation of the transfer drum.

FIG. 6 shows a flow for driving the charger 12 during the even-numbered rotation of the transfer drum so that the toner transferred onto the transfer sheet is not offset onto the photosensitive drum during the extra rotation. In the flow chart shown in FIG. 6, since the toners of four colors including black toner are transferred onto the transfer sheet, the transfer process is completed after the transfer drum is rotated seven times.

The flow chart of FIG. 7 shows a case wherein no extra rotation is necessary. Each time the transfer drum is rotated, toners of respective colors, i.e., yellow, magenta, cyan, and black, are transferred onto the transfer sheet. After the transfer drum is continuously rotated four times, the transfer process is completed. Since no extra rotation is performed in the case of FIG. 7, the toner transferred onto the transfer sheet does not face the photosensitive drum other than in the transfer process.

What is claimed is:

1. A multiple image formation apparatus for sequentially transferring color toner images formed on an image carrier onto a single transfer material, comprising:

an image carrier;

means for sequentially forming the color toner images on said image carrier;

transfer material conveying means which is moved to convey the transfer material to a transfer position of said image carrier;

transfer means for applying a transfer bias to said transfer material; and charging means for charging a surface of said image carrier to have the same polarity as a toner polarity on the transfer material, said charging means charging a surface of said image carrier when the transfer material supported by said transfer material conveying means and having a toner image thereon moves opposite to said image carrier in other than a transfer process.

2. An apparatus according to claim 1, wherein said means for charging the surface of said image carrier to have the same polarity as the toner polarity comprises a corona charger.

3. A multiple image formation apparatus for sequentially transferring color toner images formed on an image carrier onto a single transfer material, comprising:

an electrophotographic photosensitive body comprising an image carrier;

latent image forming means including (1) a corona charger for uniformly charging said photosensitive body, and (2) an optical system for exposing information light corresponding to color information;

transfer material conveying means which is moved in an endless manner to repetitively convey the transfer material to a transfer position of said photosensitive body; and bias application means for transferring a toner image on said photosensitive body onto said transfer material, wherein when said transfer material conveying means performs a rotation without executing a transfer operation during a series of transfer processes, the surface of said photosensitive body is charged to the same polarity as a toner polarity on the transfer material.

4. An apparatus according to claim 3, wherein said corona charger charges said photosensitive body surface to the same polarity as the toner polarity on said transfer material.

5. An apparatus according to claim 3, wherein the rotation without executing the transfer operation during the transfer processes is determined by a size of the transfer material supported by said transfer material conveying means.

6. An apparatus according to claim 3, wherein a latent image on said photosensitive body is developed by developing units which are exchanged with respect to said photosensitive body, the exchanging operation of said developing units being performed when said transfer material conveying means performs the rotation without executing the transfer operation during the transfer processes.

7. A multiple image formation apparatus according to claim 6, wherein said developing units comprises revolving developing means.

8. A multiple image formation apparatus according to claim 3, wherein said image formation apparatus has a plurality of developing means for developing a latent image formed by toner on said image carrier means by said latent image forming means, the toner of each of said developing means having the same polarity as the polarity of uniform charge by said corona charger.

9. A multiple image formation apparatus according to claim 3, wherein when said transfer material conveying means performs a rotation without executing a transfer operation during a series of transfer processes, said transfer material conveying means supports the transfer material having the toner image.

10. A color image formation apparatus according to claim 3, wherein said rotation is carried out during a period when a succeeding toner image is being transferred on the transfer material and after the toner image is transferred to the transfer material.

11. A color image formation apparatus according to claim 3, wherein said transfer bias is applied by the rotation of said transfer material conveying means.

12. A multiple image formation apparatus for sequentially transferring color toner images formed on an image carrier onto a single transfer material, comprising:

latent image forming means having a corona charger for uniformly charging an electrophotographic photosensitive body and an optical system for exposing information light corresponding to color information onto said photosensitive body;

a transfer material support drum, disposed to face said photosensitive body, which is rotated while supporting the transfer material to repetitively convey the transfer material to a transfer position of said photosensitive body; and a bias application corona charger for transferring a toner image on said photosensitive body to the transfer material, wherein when said transfer material support drum performs a rotation without executing transfer operation during a series of transfer processes, the surface of said photosensitive body is charged in the same polarity as a toner polarity on the transfer material.

13. An apparatus according to claim 12, wherein said corona charger charges said photosensitive body surface to the same polarity as the toner polarity on said transfer material.

14. An apparatus according to claim 12, wherein the rotation without executing the transfer operation during the transfer processes is determined by a size of the transfer material supported by said transfer material conveying means.

15. A multiple image formation apparatus according to claim 7, wherein said image formation apparatus has a plurality of developing means for developing a latent image formed by toner on said image carrier means by said latent image forming means, the toner of each of said developing means having the same polarity as the polarity of uniform charge by said corona charger.

16. A multiple image formation apparatus according to claim 12, wherein when said transfer material support drum performs a rotation without executing a transfer operation during a series of transfer processes, said transfer material support drum supports the transfer material having a transferred image.

17. A color image formation apparatus according to claim 12, wherein said rotation is carried out during a period when a succeeding toner image is being transferred on the transfer material and after the toner image is transferred to the transfer material.

18. A color image apparatus according to claim 12, wherein a latent image on said photosensitive body is developed by developing units which are exchanged with respect to said photosensitive body, the exchanging operation of said developing units being performed when said transfer material support drum performs the rotation without executing the transfer operation during the transfer process.

19. A color image formation apparatus according to claim 18, wherein said developing units comprise revolving developing means.

20. A color image formation apparatus according to claim 12, wherein said transfer bias is applied by the rotation of said transfer material conveying means.

* * * * *

UNITED STATES PATENT AND TRADEMARK OFFICE

CERTIFICATE OF CORRECTION

PATENT NO. : 4,888,621

DATED : December 19, 1989

INVENTOR(S) : AKIO OHNO

It is certified that error appears in the above-identified patent and that said Letters Patent is hereby corrected as shown below:

COLUMN 3

Line 50, "ca" should read --can--.

COLUMN 6

Line 48, "claim 7," should read --claim 12,--.

Signed and Sealed this

Fourteenth Day of January, 1992

*Attest:*

HARRY F. MANBECK, JR.

*Attesting Officer*

*Commissioner of Patents and Trademarks*